United States Patent [19]

Kemp, Jr. et al.

[11] Patent Number: 4,800,064

[45] Date of Patent: Jan. 24, 1989

[54] PROCESS FOR PRODUCING TUNGSTEN HEAVY ALLOY SHEET USING HYDROMETALLURGICALLY PRODUCED TUNGSTEN HEAVY ALLOY

[75] Inventors: Preston B. Kemp, Jr., Athens; Walter A. Johnson, Towanda; Nelson E. Kopatz, Sayre, all of Pa.

[73] Assignee: GTE Products Corporation, Stamford, Conn.

[21] Appl. No.: 143,864

[22] Filed: Jan. 14, 1988

[51] Int. Cl.[4] ..... B22F 1/00

[52] U.S. Cl. ..... 419/36; 75/0.5 A; 75/0.5 AB; 75/248; 419/40; 419/43; 419/46; 419/47; 419/54

[58] Field of Search ..... 75/0.5 A, 0.5 AB, 248; 419/36, 40, 43, 47, 54, 46

[56] References Cited

U.S. PATENT DOCUMENTS 3,890,145 6/1975 Hivert et al. ..... 419/36

4,698,096 10/1987 Schmidberger et al. ..... 75/248

*Primary Examiner*—Stephen J. Lechert, Jr.

*Attorney, Agent, or Firm*—Donald R. Castle; L. Rita Quatrini

[57] ABSTRACT

A process is disclosed for producing a sheet of tungsten heavy alloy which involves forming a solution of chemical compounds containing the metal values of the alloy in the correct proportion as in the alloy, crystallizing the compounds from solution and drying the compounds, reducing the compounds to their respective metals wherein each particle is an admixture of the allow components; forming a slurry of the metals and a liquid medium, removing the liquid medium from the metals and forming a planar cake of the metals, drying the cake, and sintering the cake to a density equal to or greater than about 90% of the theoretical density of the alloy to form the sheet.

5 Claims, No Drawings

PROCESS FOR PRODUCING TUNGSTEN HEAVY ALLOY SHEET USING HYDROMETALLURGICALLY PRODUCED TUNGSTEN HEAVY ALLOY

CROSS REFERENCE TO RELATED APPLICATIONS

This invention is related to the following applications: entitled "Process For Producing Tungsten Heavy Alloy Sheet", Ser. No. 143,866; entitled "Process For Producing Tungsten Heavy Alloy Sheet Using A Metallic Salt Binder", Ser. No. 143,878; entitled "Process For Producing Tungsten Heavy Alloy Sheet By Direct Hydrometallurigical Process", Ser. No. 143,873; entitled "Process For Producing Tungsten Heavy Alloy Sheet Using High Temperature Processing Techniques", Ser. No. 143,869; and entitled "Process For Producing Tungsten Heavy Alloy Sheet By A Loose Fill Hydrometallurgical Process", Ser. No. 143,865, all of which are filed concurrently herewith and all of which are assigned to the same assignee as the present application.

This invention relates to a process for producing tungsten heavy alloy sheet by sintering a preform planar cake which is substantially close in thickness to the final thickness of the rolled sheet. More particularly, the cake is formed from metal powder particles each of which is an admixture of the alloying elements, the admixture having been hydrometallurgically produced from a solution of compounds of the metal values.

BACKGROUND OF THE INVENTION

Tungsten heavy alloy sheet is currently produced by powder consolidation using cold isostatic pressure followed by a series of alternate hot rolling and annealing steps. The sheet must be annealed after about each 30% reduction in thickness.

It would be desirable to make a sheet preform substantially close in thickness to the final thickness of the rolled sheet. This would reduce the time, energy, and labor required for hot rolling and annealing.

U.S. Pat. No. 2,735,757 relates to a process for forming iron metal powder from iron salts by oxidizing a solution of the iron salts to produce a hydrate sludge of the iron, followed by reducing the iron to the metal powder.

U.S. Pat. No. 3,663,667 discloses a process for producing multimetal alloy powders wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce the metallic compounds to temperatures below the melting point of any of the metals in the alloy.

U.S. Pat. No. 4,348,224 relates to a process for producing fine cobalt metal powder by digesting cobalt bearing scrap in hydrochloric acid to produce an aqueous cobalt acid chloride solution containing copper and silver ions which are removed by cementation with iron to result in a cobalt chloride solution which is processed to fine cobalt metal powder.

U.S. Pat. Nos. 3,663,667, and 4,348,224 are assigned to the same assignee as the present invention.

SUMMARY OF THE INVENTION

In accordance with one aspect of this invention, there is provided a process for producing a sheet of tungsten heavy alloy which involves forming a solution of chemical compounds containing the metal values of the alloy in the correct proportion as in the alloy, crystallizing the compounds from solution and drying the compounds, reducing the compounds to their respective metals wherein each particle is an admixture of the alloy components; forming a slurry of the metals and a liquid medium, removing the liquid medium from the metals and forming a planar cake of the metals, drying the cake, and sintering the cake to a density equal to or greater than about 90% of the theoretical density of the alloy to form the sheet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The process of the present invention relates to a process for producing tungsten heavy alloy sheet by first crystallizing from solution chemical compounds containing metal values of the alloy. The compounds are reduced to the metals in the form of an admixture of the alloy components by virtue of the crystallization from solution. A planar cake is then formed of the admixture of hydrometallurgically produced powders via formation of a slurry and removing the liquor. The cake is then sintered to form the sheet which can then be further rolled and annealed. This cake can then be processed to form a sheet which is substantially close in thickness to the final thickness of the rolled sheet. As a result of formation of this type of cake, there is a reduction in time, energy and labor required for hot rolling and annealing.

Some tungsten heavy alloys which are especially suited to this invention are tungsten-iron-nickel alloys especially those in which the Ni:Fe weight ratio is from about 1:1 to about 9:1 and most preferably about 8:2. As an example of these preferred alloys are those having the following compositions in percent by weight: about 8% Ni, about 2% Fe, and the balance W, about 4% Ni, about 1% Fe, and the balance W, and about 5.6% Ni, about 1.4% Fe, and the balance W. The alloys can be with or without additions of Co and/or Cu.

A solution is first formed of chemical compounds containing metal values of the alloy in the correct proportion as in the alloy. This can be done by any technique, such as by dissolving the compounds as is, in solution.

In accordance with one embodiment, the elemental metal powder components of the alloy are first dissolved in an acid solution. Calculation of the required relative amounts of the elemental powders is determined by the composition of the alloy to be produced. Dissolution of metal values in acid solution and calculation of the amounts of metal required for the alloy composition can be done by anyone skilled in the art. The acid can be a mineral acid such as hydrochloric, sulfuric and nitric acids or an organic acid such as acetic, formic and the like. Hydrochloric acid is especially preferred because of cost and availability. As a result of the acid dissolution of the metal powders, compounds of the respective metals are formed as precipitates. Those skilled in the art would know how to dissolve metal values in acid solution in the correct proportions.

In accordance with another embodiment, nickel powder and iron powder are dissolved in hydrochloric acid. A concentrated solution of ammonium metatungstate is added to the hydrochloric acid solution of nickel and iron. The amounts of iron, nickel and tungsten have been calculated to be the proper amounts to result in the desired alloy composition. The pH of the resulting solution is raised to the basic side usually to pH of about 6.5 to 7.5 with ammonia or ammonium hydroxide to precipitate the tungsten as ammonium paratungstate (APT) and the iron and nickel as their hydroxides.

The resulting compounds are then removed from solution. This is done by any standard technique such as by filtration of the precipitate of the compounds which has formed. In this case, the compounds are then dried. Alternately, if the compounds are highly soluble as is the case when ammonium metatungstate is one of the compounds, the solution can be spray dried to crystallize the compounds.

The compounds, if they are insoluble in water can then be water washed if desired to remove any contaminants.

The compounds are then reduced to the metals. This is done by standard reduction techniques. For example, the reduction to the metals can be done in one step or in more than one step. As an example of the latter, the compounds which can be predried, are first heated to decompose them into their oxides. Temperature depends on the nature of the metals. Time depends on the nature of the metals, temperature, amount of material being processed, the equipment, etc. Anyone skilled in the art would know how to reduce the compounds to the metals. In the case of ammonium paratungstate, (APT), iron hydroxide and nickel hydroxide, the reduction is done as follows. The reduction furnace is slowly ramped from room temperature to almost about 275° C. to remove ammonia and water vapor from the APT to form WO3. The temperature is next ramped to 750° C. to about 800° C. to reduce the hydroxides and oxides to their respective metals. As a result of the reduction of the hydrometallurgically produced compounds, each of the resulting metal particles is an admixture in itself of all the component metals which form the alloy.

A slurry of the resulting hydrometallurgically produced metal powders is then formed in a liquid medium. The liquid medium can be water or organic solvents, which can be oxygen containing organic solvents and non-oxygen containing organic solvents. Typical oxygen-containing organic solvents are alcohols, one in particular being reagent alcohol which has a weight composition of about 90% ethyl alcohol, about 5% methyl alcohol, and about 5% isopropyl alcohol. Other solvents that can be used are alkane hydrocarbon liquids and chlorinated hydrocarbon liquids. The slurry can have other components such as organic and inorganic binders, etc. The actual formation of the slurry can be done by standard methods.

The liquid medium is then removed from the metal powders. This is done in such a way so that the powders form into a planar cake which is substantially close in thickness to the thickness of the final rolled sheet. The thickness of the sheet is typically from about 0.1" to about 0.5" after sintering and before rolling. By a planar cake is meant that the powder is uniform in thickness and density across the length and width of the cake. The cake is uniform in composition throughout by virtue of the fact that each particle is an admixture of the alloy components. The preferred methods of forming the planar cake are by using a porous filter medium and applying vacuum, gas pressure, or mechanical pressure. Vibration can also be used if this is desirable. The liquid removal can be accomplished by batch or continuous processing.

The resulting cake is then dried by conventional powder metal drying methods to remove essentially all the liquid therefrom, the methods being selected to reduce or eliminate cracking during drying. Any organic binders which may present are removed by standard dewaxing techniques.

At this point, if the liquid medium of the slurry has been water or an oxygen containing organic solvent, oxygen must be removed from the cake. This is done by heating the cake in hydrogen at a temperature sufficient to reduce any metal oxides which are present to their respective metals but below the normal sintering temperatures of any metal contained therein. By "normal sintering temperature" is meant the temperature at which the cake is sintered to the final desired density. A minor amount of sintering can take place at this point and this is advantageous because it strengthens the cake and it is easier to handle if handling is necessary. This temperature is most typically from about 800° C. to about 1000° C. The time of heating depends on factors as the temperature, size of charge, thickness of the cake, nature of the equipment, etc.

The resulting dried and heated cake is then sintered by well known methods to a density at or near the theoretical density. This is considered to be equal to or greater than about 90% of the theoretical density of the alloy. Depending on the application and on the composition, the cake can be solid state or liquid phase sintered to form the sheet. For example, if the sheet is to be rolled, it is necessary to get the density to at least about 90% to about 93% of the theoretical. With a weight composition consisting essentially of about 7% Ni, about 3% Fe, and about 90% W, solid state sintering would be sufficient. Sintering temperatures and times depend on the nature of the alloy and on the density desired for the specific application. In the example above, the solid state sintering temperature is from about 1400° C. to about 1430° C. Liquid phase sintering is preferable for better rolling, higher density and healing of cracks which can form during drying. Densities of about 99.4% of theoretical have been achieved. Usually liquid phase sintering results in a more uniform composition of the alloy components throughout the sheet.

The resulting sheet can now be processed by known methods of hot rolling and annealing to form the final size sheet. However, when the process of the present invention is followed to produce the prerolled and preannealed sheet, less rolling and annealing are required than with sheets formed by prior art methods. This is because the cake has been formed to a size very close to the desired size of the final sheet. The liquid phase sintering temperature is above the solidus temperature of the matrix phase of the alloy but below the melting point of tungsten.

To more fully illustrate this invention, the following nonlimiting example is presented. All parts, portions and percentages are on a weight basis unless otherwise stated.

EXAMPLE

About 60 parts of Ni powder are dissolved in about 240 parts of concentrated hydrochloric acid and about 200 parts of water. About 25.5 parts of Fe powder is dissolved in about 120 parts of concentrated hydrochloric acid and about 100 parts of water. The resulting solutions are combined. About 1103 parts of ammonium metatungstate are dissolved in about 1000 parts of water and the resulting solution is combined with the iron-nickel acid solution. The pH is raised to about 6.5 to 7.5 with ammonium hydroxide to precipitate APT, and the nickel and iron hydroxides which are then filtered off. The resulting precipitate is then reduced to the metals as follows. The reduction furnace is slowly ramped from room temperature to almost about 275° C. to remove ammonia and water vapor from the APT to form $WO_3$. The temperature is next ramped to 750° C. to about 800° C. to reduce the hydroxides and oxides to their respective metals. As a result of reducing compounds which have been hydrometallurgically produced from solution, each of the resulting metal particles is an admixture in itself of all the component metals which form the alloy. A slurry of the precipitate is then formed. The solids are then removed from the liquid medium in the form of a planar cake. The cake is then dewaxed to remove binders. The cake is then sintered.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) forming a solution of chemical compounds containing metal values of said alloy in the correct proportion as in said alloy;

(b) crystallizing said compounds from said solution and drying said compounds;

(c) reducing said compounds to their respective metals wherein each particle is an admixture of the alloy components;

(d) forming a slurry of said metals and a liquid medium;

(e) removing said liquid medium from said metals and forming a planar cake of said metals;

(f) drying said cake; and (g) sintering said cake to a density equal to or greater than about 90% of the theoretical density of said alloy to form said sheet.

2. A process of claim 1 wherein said liquid medium is selected from the group consisting of water, oxygen containing organic solvents and non-oxygen containing organic solvents.

3. A process of claim 2 wherein said liquid medium is selected from the group consisting of water and oxygen-containing organic solvents.

4. A process of claim 3 wherein the dried cake before the sintering step is heated in hydrogen at a temperature sufficient to reduce any metal oxides which are present to their respective metals but below the sintering temperature of any metal contained therein.

5. A process of claim 4 wherein the temperature is from about 800° C. to about 1000° C.

* * * * *